US010105745B2

(12) United States Patent
Adams

(10) Patent No.: US 10,105,745 B2
(45) Date of Patent: Oct. 23, 2018

(54) METHOD OF MANUFACTURING A METAL VESSEL

(71) Applicant: THE COCA-COLA COMPANY, Atlanta, GA (US)

(72) Inventor: John E. Adams, Alpharetta, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 0 days.

(21) Appl. No.: 15/225,049

(22) Filed: Aug. 1, 2016

(65) Prior Publication Data

US 2016/0354831 A1 Dec. 8, 2016

Related U.S. Application Data

(63) Continuation of application No. 12/418,758, filed on Apr. 6, 2009, now abandoned.

(51) Int. Cl.

| | |
|---|---|
| ***B21D 22/02*** | (2006.01) |
| ***B21D 22/20*** | (2006.01) |
| ***B21D 51/18*** | (2006.01) |
| ***B21D 51/24*** | (2006.01) |

(52) U.S. Cl.

CPC ..... *B21D 51/24* (2013.01); *B21D 22/02* (2013.01); *B21D 22/20* (2013.01); *B21D 51/18* (2013.01)

(58) Field of Classification Search

CPC ..... B21D 51/24; B21D 51/18; B21D 22/20; B21D 22/02; B21D 22/30; B21D 5/02; B21D 51/2615; B21D 22/28; B21D 51/2676; B21D 51/28; B21D 51/32; B21D 53/00; B65D 2543/00296; B65D 21/0234; B65D 7/12; F17C 13/086; B23Q 7/1426; B23Q 37/00; H01B 13/225; A44C 27/00; B21C 37/157; B23B 5/16

USPC ..... 72/347–349, 379.4, 379.2; 413/69, 413/72–75, 77; 29/34 R, 563, 564, 564.1, 29/33 S, 33 Q, 33 D, 33 T; 220/4.21, 220/4.24, 4.25, 4.01

See application file for complete search history.

(56) References Cited

U.S. PATENT DOCUMENTS

| | | | | |
|---|---|---|---|---|
| 4,340,866 A | | 7/1982 | Metz | |
| 4,502,313 A | * | 3/1985 | Phalin | B21D 22/28 72/342.3 |
| 5,539,670 A | * | 7/1996 | Maltby | G01B 7/06 324/648 |

(Continued)

FOREIGN PATENT DOCUMENTS

| | | | | |
|---|---|---|---|---|
| WO | WO9615865 A1 | | 5/1996 | |
| WO | WO 2009118597 A2 | * | 10/2009 | B65B 9/042 |

*Primary Examiner* — David Bryant
*Assistant Examiner* — Lawrence Averick

(57) ABSTRACT

The present invention relates to a method of manufacturing a metal vessel by way of stamping of vertical halves from a metal sheet, and in particular to a method comprising: stamping at least a first vessel half and a second vessel half from a metal sheet; adhering at least the first vessel half with the second vessel half forming a vessel, the vessel being a single piece article having an opening on one end for ingress and egress of a liquid or a gas and having a seam along two of the vessel vertical walls and along the bottom of the vessel where the first vessel half and the second vessel half make contact; and applying a top finish at the opening of the vessel allowing for a closure to be used to seal and selectively reseal the vessel.

19 Claims, 5 Drawing Sheets

(56) References Cited

U.S. PATENT DOCUMENTS

| | | | | | |
|---|---|---|---|---|---|
| 5,645,188 | A * | 7/1997 | Gray | B65D 85/73 | 220/23.86 |
| 6,030,710 | A * | 2/2000 | Nitowski | B05D 7/16 | 427/409 |
| 6,857,188 | B2 * | 2/2005 | Maus | B01D 39/12 | 29/890 |
| 6,857,304 | B2 * | 2/2005 | Enoki | B21D 51/26 | 72/348 |
| 7,371,432 | B2 * | 5/2008 | Guthrie | B05D 3/068 | 220/622 |
| 9,623,451 | B2 * | 4/2017 | Al-Zaid | B08B 3/14 | |
| 2002/0005054 | A1 * | 1/2002 | Beierling | B21C 37/0811 | 72/113 |
| 2003/0116537 | A1 * | 6/2003 | Meyer | B21D 51/18 | 219/78.16 |
| 2004/0013927 | A1 * | 1/2004 | Lawrence | H01M 8/04186 | 429/492 |
| 2007/0257039 | A1 * | 11/2007 | Chammas | A01N 1/02 | 220/500 |
| 2008/0050205 | A1 * | 2/2008 | Boltshauser | B23K 26/28 | 413/1 |
| 2008/0127705 | A1 * | 6/2008 | Sasso | B21D 51/2692 | 72/379.4 |
| 2009/0003972 | A9 * | 1/2009 | Boltshauser | B21C 37/09 | 413/8 |
| 2011/0071009 | A1 * | 3/2011 | Bartoli | B65B 9/042 | 493/52 |
| 2012/0049399 | A1 * | 3/2012 | Al-Zaid | B08B 3/14 | 264/122 |

* cited by examiner

METHOD OF MANUFACTURING A METAL VESSEL

TECHNICAL FIELD OF THE INVENTION

This invention relates to a method of manufacturing a metal vessel by way of stamping of vertical halves from metal sheet, and in particular to a method comprising: stamping at least a first vessel half and a second vessel half from a metal sheet; adhering at least the first vessel half with the second vessel half forming a vessel, the vessel being a single piece article having an opening on one end for ingress and egress of a liquid or a gas and having a seam along two of the vessel vertical walls and along the bottom of the vessel where the first vessel half and the second vessel half make contact; and applying a top finish at the opening of the vessel allowing for a closure to be used to seal and selectively reseal the vessel.

BACKGROUND OF THE INVENTION

Before our invention current shaped metal package manufacturing was both very complex and costly when compared to the manufacture of a standard straight walled metal can. In addition, additional process input metal is required when drawn and ironed (D&I) cylinders are used in the process of shaping metal packages. The additional input metal is needed to compensate for cylinder wall thinning as the cylinder is stretched and shaped during the forming process. As a consequence, the additional input metal in the form of a thicker walled metal sheet leads to heavier sidewall metal thicknesses. Though required due in part to the extensive metal work required to stretch, shape, and then trim the metal package, this is an undesirable result of the drawn and ironed process and increases metal packaging costs and manufacturing complexities.

In addition, there are numerous limitations of the drawn and ironed process when used for shaped metal packages. One such limitation is that the drawn and ironed process can only produce symmetrically shaped configurations around the shaped metal body. Another limitation is that added steps to the drawn and ironed process must often be added, such as additional necking with longer stroke length, to shape the metal package to a final form. Another limitation with respect to reforming is that the process is limited by the shaped metal package maximum expansions, for aluminum this is typically in the range of 8-10% of the ironed can sidewalls.

These shortcomings and limitations in effect limit the use of the drawn and ironed techniques in shaped metal packaging and as such limits the uses of shaped metal packaging in the marketplace and within the beverage and food industry to only premium price point beverage and food products and locations. There is a long felt need for a low cost high speed shaped metal vessel manufacturing method to create metal vessels that use less metal, and overcome the limitations mentioned above as well as overcome other limitations, which gives rise to the present invention.

SUMMARY OF THE INVENTION

The shortcomings of the prior art are overcome and additional advantages are provided through the provision of a method of manufacture of a metal vessel by way of stamping of vertical halves from a metal sheet, the method comprising: stamping at least a first vessel half and a second vessel half from a metal sheet; adhering at least the first vessel half with the second vessel half forming a vessel, the vessel being a single piece article having an opening on one end for ingress and egress of a liquid or a gas and having a seam along two of the vessel vertical walls and along the bottom of the vessel where the first vessel half and the second vessel half make contact; and applying a top finish at the opening of the vessel allowing for a closure to be used to seal and or reseal the vessel.

Additional shortcomings of the prior art are overcome and additional advantages are provided through the provision of precoating the first vessel half and the second vessel half with a polymer such that further cleaning of the first vessel half and the second vessel half is avoided, decorating the vessel with a graphic or varnish, varnishing the vessel side walls protecting decoration and metal surfaces, curing the graphic or varnish on the vessel, and identifying defects in the vessel by an inspection test.

System and computer program products corresponding to the above-summarized methods are also described and claimed herein. Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
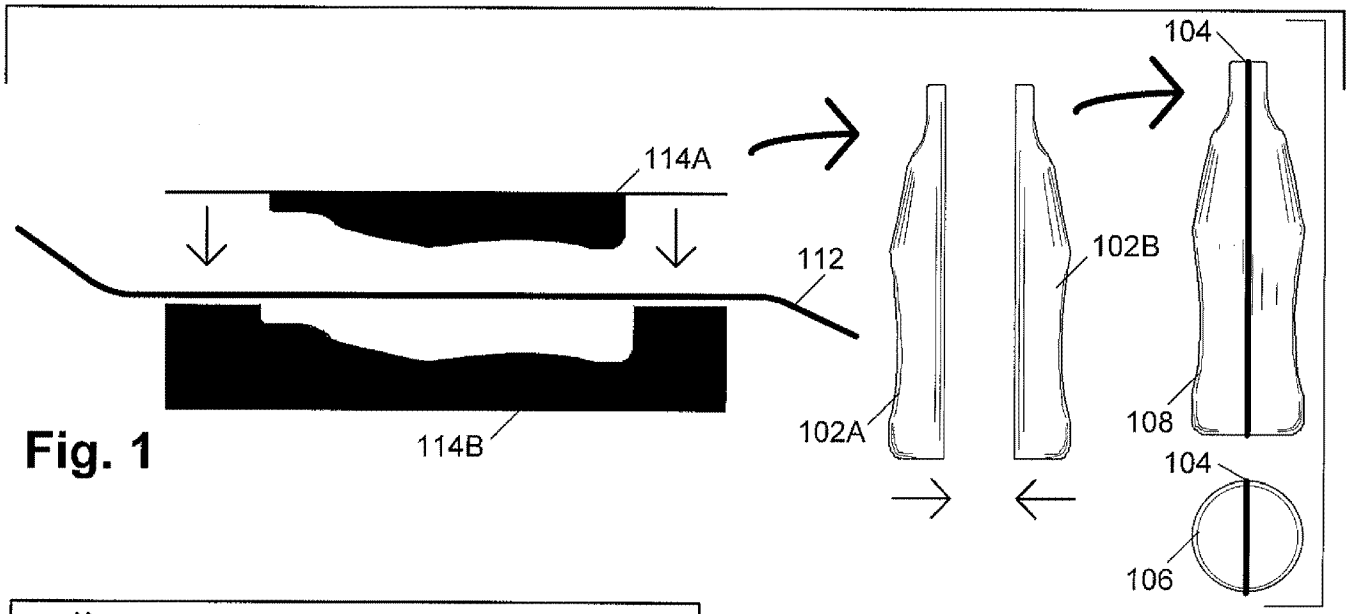
FIG. 1 illustrates one example of a method manufacturing a metal vessel by way of stamping of vertical halves from a metal sheet.

Turning now to the drawings in greater detail, it will be seen that in FIG. 1 there is illustrated one example of manufacture of a metal vessel by way of stamping of vertical halves 102A-B from a metal sheet 112. Such a metal sheet 112 can be aluminum, aluminum alloy, steel, steel alloy, or other metal. In an exemplary embodiment, a metal sheet 112 can have stamped from it by way of metal stamping equipment 114A-B one half of a vessel 102A or 102B. These half vessels 102A-B, also referred to as a first vessel half 102A and a second vessel half 102B can be combined and adhered together to form a vessel 108. The adhering of the vessel halves 102A-B can be effectuated by way of ultrasonic, magnetic pulse welding, laser welding, adhesive bond, or mechanical fit between the at least first vessel half and the second vessel half, and or by way of other adhering methods as may be required and or desired in a particular embodiment. In an exemplary embodiment, the seam 104 follows the contour of the vessel shape along the lines of contact between the vessel halves 102A-B.

In an exemplary embodiment, for example and not a limitation, the first vessel half 102A with the second vessel half 102B form a vessel 108, the vessel 108 being a single piece article having an opening 116 on one end for ingress and egress of a liquid or a gas and having a seam 104 along two of the vessel vertical walls where the first vessel half 102A and the second vessel half 102B make contact. FIG. 1 illustrates the seam 104 along the vertical walls of vessel 108 and bottom 106 of vessel 108. Such first and second vessel halves 102A-B can be symmetrical or asymmetrical in shape, as may be required and or desired in a particular embodiment.

An advantage of the present invention in contrast to prior art can making method is that the present invention simplifies the manufacturing process, enables higher manufacturing speeds, uses less metal in the shaped vessel 108 manufactured, and effectuates greater flexibility and design options in vessel 108 shaping including the ability to manufacture asymmetrical vessel shapes. The present invention also promotes lower undesirable emissions in the manufacturing process, particularly when polymer coated metal 112 is used.

Another advantage of the manufacturing method of the present invention is that it produces a lower cost vessel 108 that requires less metal in the sidewall areas when compared to current drawn and ironed formed metal packages. This effectuates the ability to use shaped metal packaging for more products, better differentiating the brand on the shelf, in more markets and with more products at a better packaging cost price point, all of which benefits the consumer. In addition, in beverage and food applications, the vessel of the present invention provides low cost barrier protection form oxygen and carbon dioxide ingress and egress with respect to beverage and food contents stored within the vessel 108; this is a highly desirable feature in smaller size vessel 108 packages.

Figure 2B:
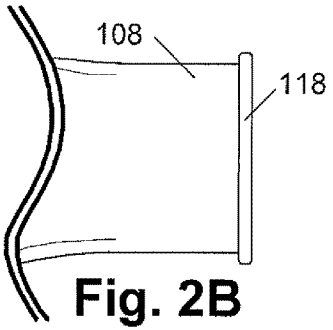
FIG. 2B illustrates one example of a rolled top finish for receiving a crown closure added to the vessel to effectuate the ability to seal the vessel opening.
Figure 2A:
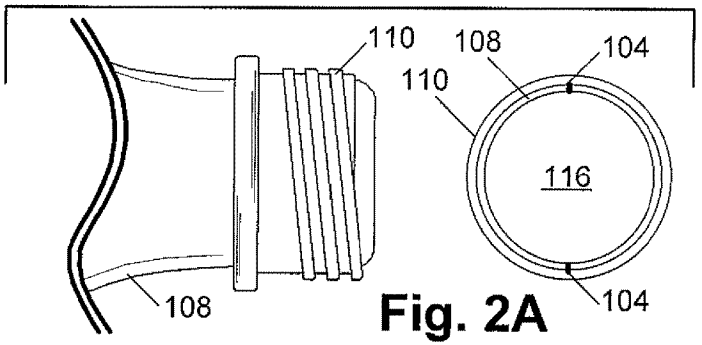
FIG. 2A illustrates one example of a threaded top finish referred to as an outsert added to the vessel to effectuate the ability to remove and secure a closure to the vessel effectively sealing and or resealing the vessel opening.

Referring to FIG. 2A there is illustrated one example of a threaded top finish referred to as an outsert 110 added to the vessel 108 to effectuate the ability to remove and secure a closure to the vessel effectively sealing and or resealing the vessel 108 opening 116. In this regard, an outsert is applied around the opening 116 of the vessel to allow for a closure to be used to seal and or reseal the vessel 108. In an exemplary embodiment, an outsert 110 made from rubber, plastic, or other material can be rolled, slipped, or otherwise positioned around the outside surface of the vessel 108 at the opening. This outsert 110 can have a thread pattern as illustrated in FIG. 2A such that a mating screw cap type closure can be attached to the vessel effectively sealing and or resealing the vessel 108.

In an exemplary beverage packaging application embodiment, for example and not a limitation, the closure can be both removable and securable at the vessel 108 opening allowing a consumer to open the vessel by removing the closure, consuming a portion of the vessel contents and then resealing the vessel by securing the closure around the outsert 110 to prevent the vessel 108 from leaking and in the case of carbonated beverages, preventing the beverage from depleting unnecessarily the beverage carbonation.

Referring to FIG. 2B there is illustrated one example of a rolled top finish 118 for receiving a crown closure added to the vessel to effectuate the ability to seal the vessel 108 opening 116. For purposes of disclosure a threaded outsert 110 for receiving a screw cap closure, an insert for receiving threaded and snap closures, a flanged top for receiving a can top end 120, or a rolled top 118 for receiving a crown type closure can be referred to as a top finish and be located at the opening of the vessel 108. In this regard, a top finish effectuates the ability to seal and optionally reseal the vessel 108.

Figure 3:
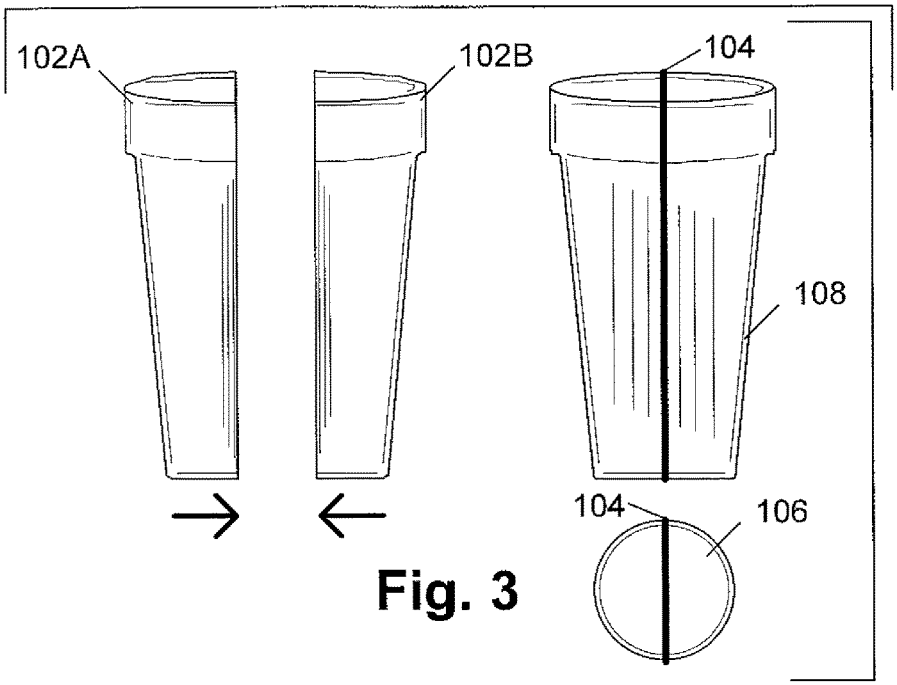
FIG. 3 illustrates one example of a cup shaped vessel.

Referring to FIG. 3 there is illustrated one example of a cup shaped vessel 108. In an exemplary embodiment, the present invention can stamp first and second vessel halves 102A-B in a cup shaped vessel 108. In this regard, the two vessel halves 102A-B can be adhered together by way of seam 104 along the vertical sides of the vessel 108 and vessel 108 bottom 106, to form a single piece article cup shaped vessel 108. Such first and second vessel halves 102A-B can be symmetrical or asymmetrical, as may be required and or desired in a particular embodiment. In an exemplary embodiment, the seam 104 follows the contour of the vessel shape along the lines of contact between the vessel halves 102A-B.

Figure 4:
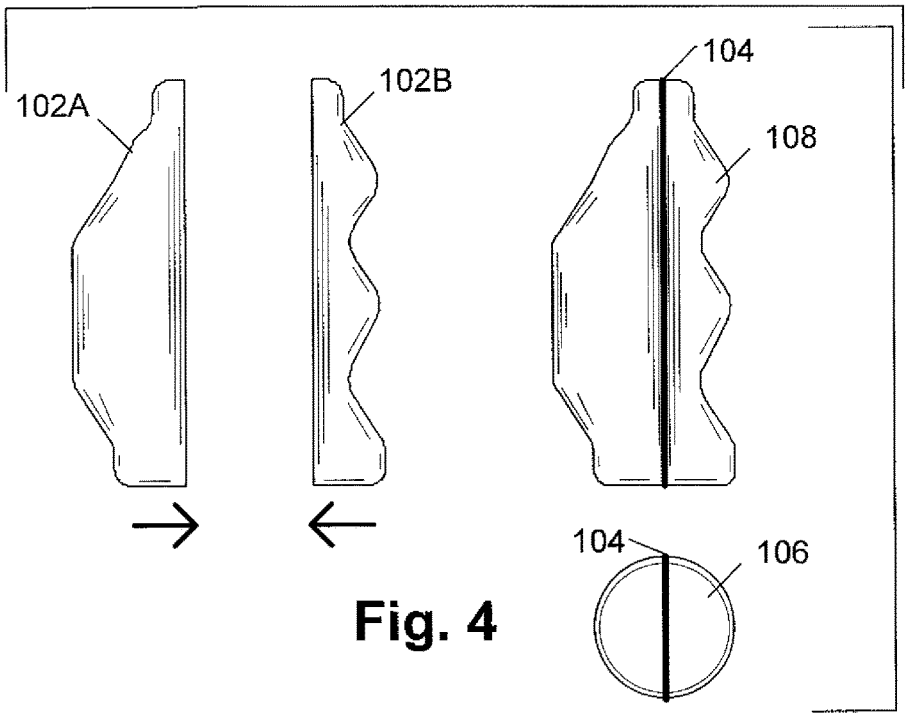
FIG. 4 illustrates one example of an asymmetrical shaped vessel.

Referring to FIG. 4 there is illustrated one example of an asymmetrical shaped vessel 108. In an exemplary embodiment, the present invention can stamp a first and second vessel halves 102A-B. The two halves 102A-B can be asymmetrical with respect to each other. In this regard, the two vessel halves 102A-B being of different shape can be adhered together by way of seam 104 along the vertical sides of the vessel 108 and vessel 108 bottom 106, to form a single piece article asymmetrical shaped vessel 108. In an exemplary embodiment, the seam 104 follows the contour of the vessel shape along the lines of contact between the vessel halves 102A-B.

Figure 5:
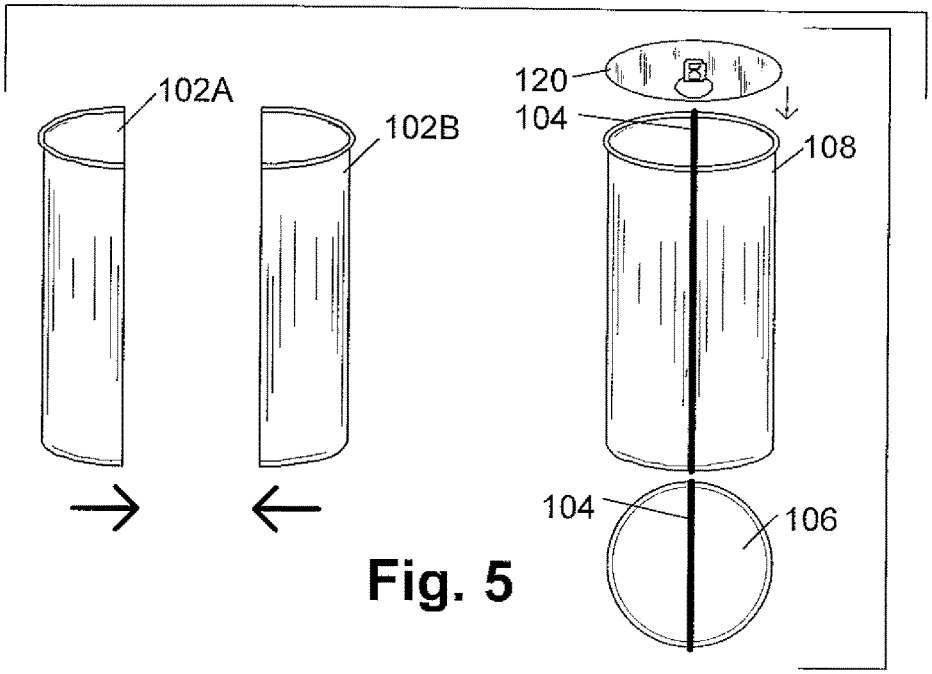
FIG. 5 illustrates one example of a can shaped vessel.

Referring to FIG. 5 there is illustrated one example of a can shaped vessel 108. In an exemplary embodiment, the present invention can stamp first and second vessel halves 102A-B in a can shaped vessel 108. In this regard, the two vessel halves 102A-B can be adhered together by way of seam 104 along the vertical sides of the vessel 108 and vessel 108 bottom 106, to form a single piece article can shape vessel 108. Such first and second vessel halves 102A-B can be symmetrical or asymmetrical, as may be required and or desired in a particular embodiment. In an exemplary embodiment a top finish can be a flange effectuating the ability to use a can top 120 as a closure. In an exemplary embodiment, the seam 104 follows the contour of the vessel shape along the lines of contact between the vessel halves 102A-B.

Figure 6:
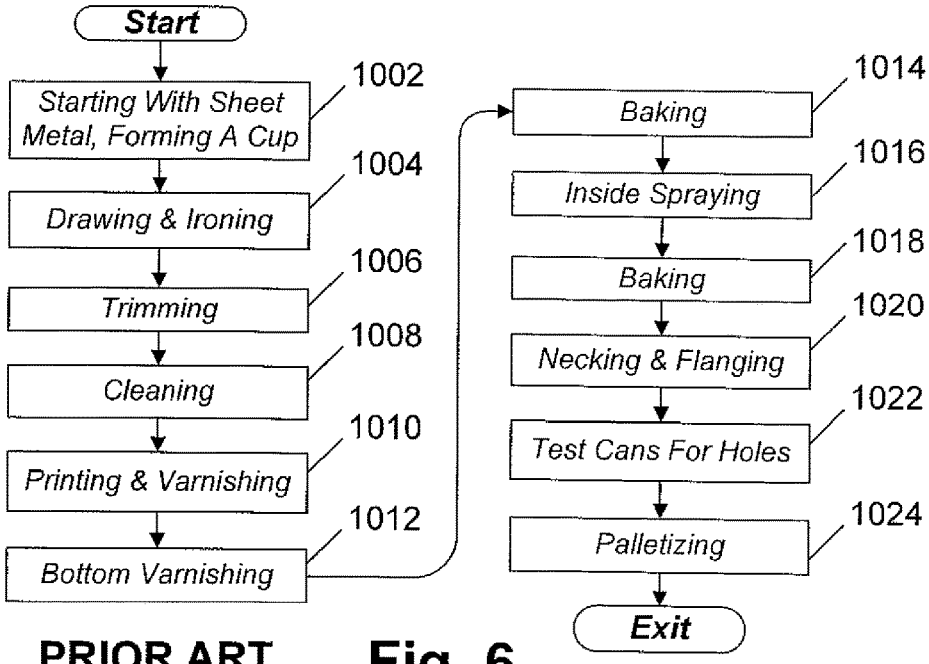
PRIOR ART Fig. 6
FIG. 6 illustrates one example of a prior art method of manufacturing a metal can by way of the drawn and ironed method.

Referring to FIG. 6 there is illustrated one example of a prior art method of manufacturing a metal can by way of the drawn and ironed method. The ALUMINUM ASSOCIATION, INC. details on their website WWW.ALUMINUM.ORG an industry recognized prior art method of making a metal can by way of the drawn and ironed method. In order to compare and contrast the present invention with the prior art method FIG. 6 summarizes the prior art can making method and FIG. 7-10F illustrates examples and exemplary embodiments of manufacturing a metal vessel of the present invention. The prior art method begins in block 1002 with a coiled sheet of metal which is fed through a press that punches out shallow cups. The prior art method then continues in block 1004.

In block 1004 the cups are fed into an ironing press where successive rings draw and iron the cup. In this regard, the side wall thickness is reduced to get a full length can and the bottom is domed to obtain strength required to withstand internal pressure. The prior art method continues in block 1006. In block 1006 the can is spun as a cutting tool trims the rough can shell from the inside. The prior art method continues in block 1008.

In block 1008 the can is cleaned and pre-treated for decoration and inside coating. In this regard, the can is pre-cleaned with a water rinse, cleaned with commercial cleaner, cold water rinsed, conditioned, cold water rinsed again, deionized water rinse, and then dried. The prior art method continues in block 1010.

In block 1010 the can is printed and varnished. In this regard, the can is printed and a clear protective over varnish is applied. The prior art method continues in block 1012. In block 1012 a varnish coating is applied to the bottom of the can. The prior art method continues in block 1014. In block 1014 the can is baked in an oven to dry the printing. The prior art method continues in block 1016. In block 1016 the inside of the can is sprayed with a coating. The prior art method continues in block 1018. In block 1018 the can is baked again to dry the coating on the inside of the can. The prior art method continues in block 1020. In block 1020 the can neck is reduced and flanged to accept an end cap. The prior art method continues in block 1022. In block 1022 the can is tested for holes. The prior art method continues in block 1024. In block 1024 the can is palletized with a plurality of cans for shipment to a customer and the prior art method is exited.

In contrast to the prior art can making method of FIG. 6, referring now to FIGS. 7-10F there is illustrated examples of a method of manufacture of a metal vessel by way of stamping of vertical halves from a metal sheet. In an exemplary embodiment, metal vessel halves 102A-B can be stamped from a sheet of metal 112. This step eliminates the prior art steps of cupping and drawing and ironing of the prior art can manufacture method.

Once stamped, the stamped metal vessel halves 102A-B of the present invention can then selectively be cleaned, as may be required and or desired in a particular embodiment. In some embodiments, wherein a polymer coating has been pre-applied to the stamped metal halves the step of cleaning may not be required. In an exemplary embodiment, such a polymer can be polyethylene terephthalate (PET) or other types or kinds of polymers. In contrast, the prior art can making method requires extensive cleaning steps including water rinse, cleaning with commercial cleaner, cold water rinse, conditioning, cold water rinse again, deionized water rinse, and then drying.

In the present invention the stamped metal halves 102A-B can be positioned and as necessary secured for adhering. The metal vessel halves 102A-B are then adhered together to form a vessel 108. The vessel 108 is a single article and has an opening 116 on the top for ingress and egress of a liquid or a gas. Preferable the opening in the top of the vessel is sized in the range of 10 millimeters to 80 millimeters for applications in the bottled beverage industry, though smaller or larger sized openings are possible, as may be required and or desired in a particular embodiment. Such a vessel 108, in a preferred embodiment, is well suited to hold a beverage at ambient pressure or other internal vessel pressures, such as under carbonation pressure, in the range of typically less than 100 pounds per square inch (psi), when the vessel is sealed with a closure.

The adhering step forms a seam 104 along the two stamped metal vessel halves 102A-B vertical walls and along the bottom of the vessel 106 where the stamped metal halves make contact, as illustrated in FIGS. 1-5. This is different from prior art can manufacturing methods, which does not perform such an adhering step. Such step of adhering the stamped metal vessel halves together, in the present invention, can include adhering by way of ultrasonic, magnetic pulse welding, laser welding, adhesive bond, mechanical fit between the stamped vessel halves, and or by other adhering methods as may be required and or desired in a particular embodiment.

In an exemplary embodiment, for example and not a limitation, the formed metal vessel 108 of the present invention can be decorated with graphics and varnishes to produce a consumer appealing vessel 108 package. Tests can be performed on the formed metal vessel 108 to insure suitability for use and other quantitative, qualitative, and performance metrics have been achieved.

In an exemplary embodiment, for example and not a limitation, the metal vessel 108 of the present invention can include a top finish. A top finish can be a threaded outsert 110 for receiving a screw cap closure, an insert for receiving threaded and snap closures, a flanged top for receiving a can top end 120, or a rolled top 118 for receiving a crown type closure. The top finish is typically located near the opening 116 of the vessel 108. In this regard, a top finish effectuates the ability to seal and optionally reseal the vessel 108.

Figure 7:
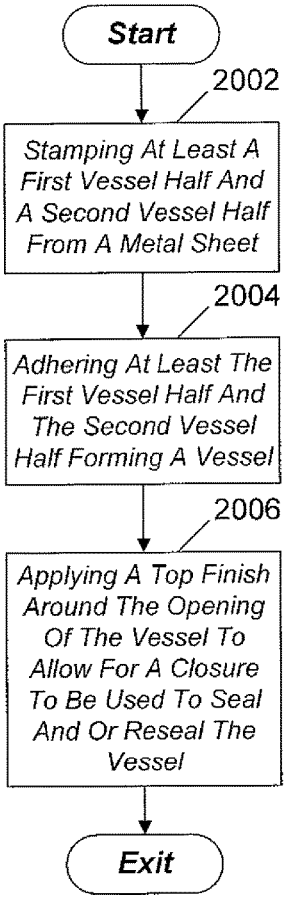
FIG. 7 illustrates one example of a method of manufacturing a metal vessel by way of stamping of vertical halves from a metal sheet.

In an exemplary embodiment, such an outsert 110 as illustrated in FIG. 2A can be rubber, plastic, or other composition and can be rolled onto, pressed into, or otherwise be positioned near vessel 108 neck at opening 116. Such an outsert 110 or insert can include threads to interface with a threaded closure allowing the closure to be removable and securable to the vessel 108 at opening 116. Alternatively, a crown type closure can be utilized with a rolled top finish 118 on the vessel 108 to seal the vessel at opening 116. Referring to FIG. 7, the method begins in block 2002.

In block 2002 stamping of at a first vessel half 102A and a second vessel half 102B from a sheet of metal 112 is performed. The first and second vessel halves 102A-B can be the same shape as illustrated in FIG. 1 vessel halves 102A-B creating a symmetrical vessel, or the vessel halves 102A-B can be different in shape as in FIG. 4 vessel halves 102A-B creating an asymmetrical vessel. The vessel halves 102A-B can also be stamped as to form a cup type vessel 108 having a wider opening at the top as shown in FIG. 3 or as a can type vessel as shown in FIG. 5.

An advantage in stamping the vessel halves 102A-B with stamping equipment 114A-B can be that several steps can be eliminated, when contrasted with the prior art drawn and ironed method of can making. In this regard, eliminated in the methods of the present invention are the steps of cupping and the process of drawing and ironing (D&I). This enables the present invention to form vessel halves 102A-B at a higher rate of speed and with fewer defects as the metal undergoes a single forming action of stamping versus the prior art can manufacturing techniques, which requires extensive drawing and ironing forming and shaping steps.

Other advantages of the present invention include being able to start with a thinner metal sheet 112 which is easier to handle and work with. In this regard, the present invention stamps vessel halves 102A-B from a metal sheet 112 that are the final wall thickness of the vessel 108. In contrast to the prior art can making method a thicker metal sheet must be used as subsequent cupping and drawing and ironing steps stretch and thin the thicker starting metal to shape the final can. This can cause a higher rate of defect cans as the metal is worked extremely hard to stretch the can into shape.

Another advantage of the present invention is the stamped vessel halves 102A-B do not require an additional step of trimming. In this regard, in contrast to the prior art can making method after the cupping and drawing and ironing steps the can edges are uneven and require a trimming step to even up the open edges. This can lead to delayed manufacturing speed with the extra step and an additional portion of the metal is cutoff as waste. The method of the present invention then continues in block 2004.

In block 2004 the first and second vessel halves 120A-B are adhered together forming vessel 108. In an exemplary embodiment, adhering the first and second vessel halves 102A-B together creates a single piece article vessel 108 having an opening 116 on one end for ingress and egress of a liquid or a gas and having a seam 104 along two of the vessel 108 vertical walls where the first vessel half 102A and the second vessel half 102B make contact. In this regard, the vessel halves 102A-B are adhered together and a seam 104 is created that traverses the vessel vertical sides and bottom surface leaving the top of the vessel 108 open. FIGS. 1-5 illustrate the adhering of the vessel halves 102A-B and the resulting seam 104. In an exemplary embodiment, the seam 104 follows the contour of the vessel shape along the lines of contact between the vessel halves 102A-B. The adhering of the vessel halves 102A-B can be effectuated by way of ultrasonic, magnetic pulse welding, laser welding, adhesive bond, or mechanical fit between the at least first vessel half and the second vessel half, and or by way of other adhering methods as may be required and or desired in a particular embodiment. The method of the present invention then continues in block 2006.

In block 2006 a top finish is applied around the opening 116 of the vessel 108 to allow for a closure to be used to seal and or reseal the vessel 108. A top finish can be a threaded outsert 110 for receiving a screw cap closure, an insert for receiving threaded and snap closures, a flanged top for receiving a can top end 120, or a rolled top 118 for receiving a crown type closure. The top finish is typically located near the opening 116 of the vessel 108. In this regard, a top finish effectuates the ability to seal and optionally reseal the vessel 108.

In an exemplary embodiment, an outsert 110 made from rubber, plastic, or other material can be rolled, slipped, or otherwise positioned around the outside surface of the vessel 108 at the opening 116. This outsert 110 can have a thread pattern as illustrated in FIG. 2A is an outsert 110 also referred to as a threaded top finish such that a mating screw type cap closure can be attached to the vessel 108 effectively sealing the vessel. In such an exemplary embodiment, for example and not a limitation, in a beverage packaging application the closure can be both removable and securable at the vessel 108 opening 116 allowing a consumer to open the vessel 108 by removing the closure, drink a portion of the vessel 108 contents and then reseal the vessel 108 by securing the closure around the outsert 110 to prevent the vessel 108 from leaking and in the case of carbonated beverage, the beverage from depleting unnecessarily the beverage carbonation. The method of the present invention is then exited.

Figure 8:
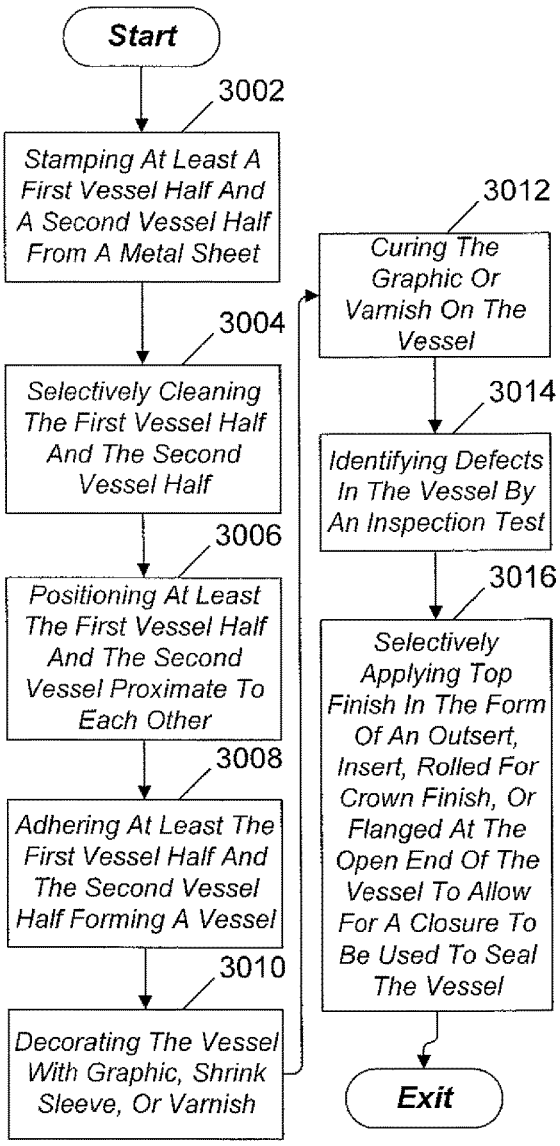
FIG. 8 illustrates one example of a method of manufacturing a metal vessel by way of stamping of vertical halves from a metal sheet.

Referring to FIG. 8 there is illustrated an example of a method of manufacture of a metal vessel 108 by way of stamping of vertical halves 102A-B from a metal sheet 112. In an exemplary embodiment, expanding on the method of FIG. 7, FIG. 8 illustrates one example of an exemplary embodiment of a method that includes positioning the vessel halves 120A-B, decorating, and identifying defects in the final vessel 108. The method of the present invention begins in block 3002.

In block 3002 stamping of at least a first vessel half 102A and a second vessel half 102B from a sheet of metal 112 is performed. The first and second vessel halves 102A-B can be the same shape as illustrated in FIG. 1 and FIG. 5 vessel halves 102A-B creating a symmetrical vessel, or the vessel halves 102A-B can be different in shape as in FIG. 4 vessel halves 102A-B creating an asymmetrical vessel 108 shape. The vessel halves 102A-B can also be stamped as to form a cup type vessel 108 as shown in FIG. 3 vessel halves 102A-B having a wider opening at the top. The method of the present invention continues in block 3004.

Figure 9:
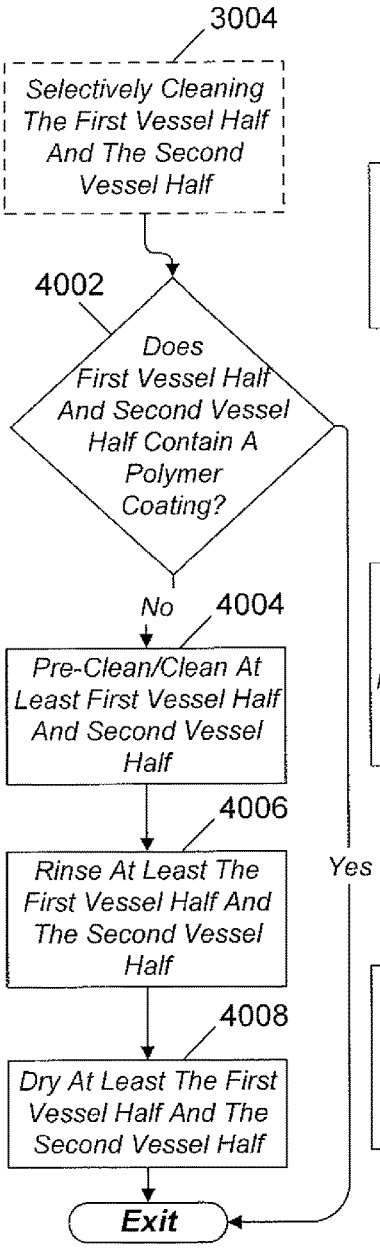
FIG. 9 illustrates one example of a method of selectively cleaning the first and second vessel halves.

In block 3004 selectively cleaning of the first and second vessel halves 102A-B can be effectuated. In an exemplary embodiment, the stamped first and second vessel halves 102A-B can be coated with a polymer and cleaning may not be necessary or required. In this regard, the starting metal may have a laminated polymer such as polyethylene terephthalate (PET) on the surface; in these types of embodiments the step of cleaning the metal may not be necessary. In other embodiments, a step of cleaning may be required and or desired to remove contaminates and debris from the stamped first and second vessel halves 102A-B. The method of FIG. 9 illustrates one example of a method of selectively cleaning the first and second vessel halves 102A-B. The method of the present invention continues in block 3006.

In block 3006 the first and second vessel halves 102A-B are positioned and secured, as necessary and or required by a particular embodiment, proximate to each other in preparation for adhering the two vessel halves 102A-B together. The method of the present invention continues in block 3008.

In block 3008 the first and second vessel halves 102A-B are adhered together forming vessel 108. In an exemplary embodiment, adhering the first and second vessel halves 102A-B together creates a single piece article vessel 108 having an opening 116 on one end for ingress and egress of a liquid or a gas and having a seam 104 along two of the vessel 108 vertical walls where the first vessel half and the second vessel halves 102A-B make contact. In this regard, the vessel halves 102A-B are adhered together and a seam 104 is created that traverses the vessel 108 vertical sides and bottom 106 surface leaving the top 116 open. FIGS. 1-4 illustrate the adhering of the vessel halves 102A-B and the resulting seam 104. The method of the present invention then continues in block 3010. In an exemplary embodiment, the seam 104 follows the contour of the vessel shape along the lines of contact between the vessel halves 102A-B.

In block 3010 the vessel is decorated with graphics, shrink sleeve, varnishes, and or other decorations. In an exemplary embodiment, the graphics are applied by way of at least one roller, shrink sleeve, ink jet, other print head, and or other print transfer methods capable of applying a plurality of colors on the vessel 108 surface. Varnishes can be applied to the vessel 108 side walls and bottom surface protecting the decoration and metal surfaces.

In addition to the varnishes being applied to exterior vessel 108 surface to protect decoration and metal surfaces, a coating can be applied to the inside of the vessel 108 forming a barrier between the vessel 108 metal surface and contents places inside the vessel. In applications involving beverage and food this coating prevents the metal from coming in contact with the beverage or food. The method of the present invention continues in block 3012.

In block 3012 the various coating, decoration, shrink sleeves, and or varnishes can be cured to set and otherwise dry. Such curing can be effectuated with a heat oven, airflow, or other curing techniques, as may be required and or in a particular embodiment. The method of the present invention continues in block 3014.

In block 3014 defects in the vessel 108 surfaces and seam 104 can be detected by way of an inspection test. In an exemplary embodiment, for example and not a limitation, an inspection test can be effectuated by way of a light test to detect pinholes in the vessel 108 surface and seam 104. In other exemplary embodiments, another vessel test can be pressure testing as may be required and or desired in a particular embodiment. The method of the present invention continues in block 3016.

In block 3016 selectively a top finish is applied around the opening 116 of the vessel 108 to allow for a closure to be used to seal and or reseal vessel 108. A top finish can be a threaded outsert 110 for receiving a screw cap closure, an insert for receiving threaded and snap closures, a flanged top for receiving a can top end 120, or a rolled top 118 for receiving a crown type closure. The top finish is typically located near the opening 116 of the vessel 108. In this regard, a top finish effectuates the ability to seal and optionally reseal the vessel 108.

In an exemplary embodiment, an outsert 110 made from rubber, plastic, or other material can be rolled, slipped, or otherwise positioned around the outside surface of the vessel 108 at the opening 116. This outsert 110 can have a thread pattern as illustrated in FIG. 2A a threaded top finish referred to as an outsert 110 such that a mating screw type cap closure can be attached to the vessel 108 effectively sealing the vessel 108. In such an exemplary embodiment, for example and not a limitation, in a beverage packaging application the closure can be both removable and securable at the vessel 108 opening 116 allowing a consumer to open the vessel 108 by removing the closure, drink a portion of the vessel contents and then reseal the vessel 108 by securing the closure around the outsert 110 to prevent the vessel 108 from leaking and in the case of carbonated beverage, the beverage from depleting unnecessarily the beverage carbonation. The method of the present invention is then exited.

Referring to FIG. 9 there is illustrated one example of a method of selectively cleaning the first and second vessel halves 102A-B. In an exemplary embodiment, the selectively cleaning step of FIG. 8 block 3004 can be further expanded upon, in an exemplary embodiment, by way of the method of FIG. 9. In this regard, a determination can be made as to whether a polymer has been applied to the first and second metal halves 102A-B in such a manner that cleaning is not necessary. If cleaning is necessary steps are performed to clean the vessel halves 102A-B, otherwise the method is exited. The method of the present invention begins in block 3004.

In block 3004 from FIG. 8 there is illustrated selectively cleaning of the first and second vessel halves 102A-B can be effectuated. In an exemplary embodiment, the stamped first and second vessel halves 102A-B can be coated with a polymer and cleaning may not be necessary or required. In this regard, the starting metal may have a laminated polymer such as polyethylene terephthalate (PET) on the surface; in these types of embodiments the step of cleaning the metal may not be necessary. The remaining steps in the method of FIG. 9 further detail one example of a selective cleaning method. The method of the present invention continues in decision block 4002.

In decision block 4002 a determination is made as to whether or not the first and second vessel halves 102A-B have a polymer coating. If the resultant is in the affirmative that is the first and second vessel halves 102A-B have a polymer coating and do not require cleaning then the method of the present invention is exited. If the resultant is in the negative that is the first and second vessel halves 102A-B do not have a polymer coating and or require cleaning then the method of the present invention continues in block 4004.

In block 4004 the first and second vessel halves 102A-B are pre-cleaned and cleaned, as necessary, using a combination of water, commercial cleaners, conditioning, and or other cleaning methods as may be required and or desired in a particular embodiment. The method of the present invention continues in block 4006.

In block 4006 the first and second vessel halves are rinsed as necessary using a combination of cold water rinse, deionized water rinse, and other rinse methods as may be required and or desired in a particular embodiment. The method of the present invention continues in block 4008.

In block 4008 the first and second vessel halves 102A-B are dried, as necessary, as may be required and or desired in a particular embodiment. The method of the present invention is then exited.

Referring to FIG. 10A-10F there is illustrated examples of exemplary embodiments of a method of manufacture of a metal vessel by way of stamping of vertical halves 102A-B from a metal sheet 112. Exemplary embodiments of the method of FIGS. 6-8 can include coating the first and second vessel halves 102A-B, coating the inside of the vessel 108, securing the vessel halves 102A-B for adhering, applying graphics to the vessel 108, varnishing the side walls of the vessel 108, and or inspecting the vessel 108. FIGS. 9A-9F illustrates examples of these various embodiments of the present invention.

Figure 10A:
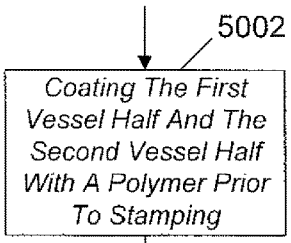
FIGS. 10A-10F illustrates examples of exemplary embodiments of a method of manufacture of a metal vessel by way of stamping of vertical halves from a metal sheet.

Referring to FIG. 10A block 5002 in an exemplary embodiment, for example and not a limitation, the first and second vessel halves 102A-B are coated with a polymer. Such coating can be applied to the metal sheet 112 prior to stamping by press 114A-B, as may be required and or desired in a particular embodiment. In an exemplary embodiment, such a polymer can be polyethylene terephthalate (PET).

Figure 10B:
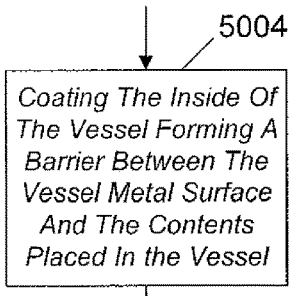

Referring to FIG. 10B block 5004 in an exemplary embodiment, for example and not a limitation, the inside of the vessel can be coated forming a barrier between the vessel 108 metal surface and the contents placed in the vessel 108. In this regard, beverage and food applications can utilize such a coating to prevent the beverage and food contents from coming in contact with the metal surface of vessel 108.

Figure 10C:
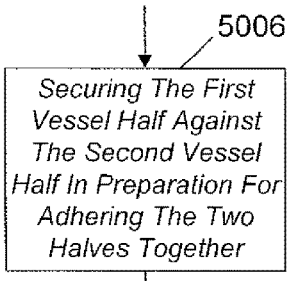

Referring to FIG. 10C block 5006 in an exemplary embodiment, for example and not a limitation, the first and second vessel halves 102A-B can be secured in preparation to adhering. In this regard, as necessary the two halves 102A-B can be secured by light adhering including ultrasonic, magnetic pulse welding, laser welding, adhesive bond, mechanical fit between at least the first vessel half and the second vessel half, or other method as may be required and or desired in a particular embodiment. In an exemplary embodiment, this can allow the first and second vessel halves 102A-B to be combined in a light or temporary manner and then transferred for adhering to the appropriate equipment.

Figure 10D:
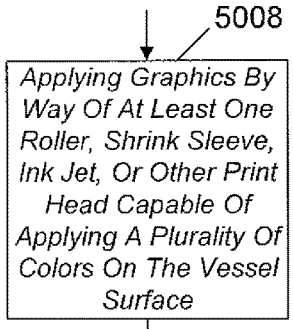

Referring to FIG. 10D block 5008 in an exemplary embodiment, for example and not a limitation, graphics can be applied to the vessel by way of at least one roller or print head that is capable of applying a plurality colors on the vessel surface. In this regard, consumer attractive decoration, information, and or other indicia can be applied to the vessel 108 surface using roller, shrink sleeve, ink jet, other print head, and or other print transfer methods as may be required and or desired in a particular embodiment.

Figure 10E:
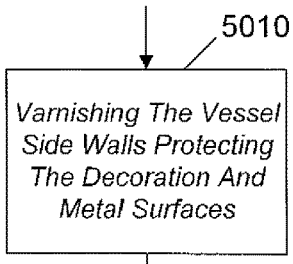

Referring to FIG. 10E block 5010 in an exemplary embodiment, for example and not a limitation, varnish can be applied to the vessel 108 side walls protecting the decoration and vessel 108 metal surfaces. In this regard, such a varnish can protect the vessel 108 decoration from scratches and scuffing during manufacture, transport, and utilization by a consumer.

Figure 10F:
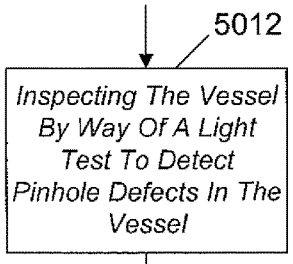

Referring to FIG. 10F block 5012 in an exemplary embodiment, for example and not a limitation, inspection of the vessel 108 by way of light test to detect pinhole defects can be effectuated. In this regard, the vessel 108 surfaces and seam 104 can be tested to insure liquids and or gases will not leak from a sealed vessel 108. In other exemplary embodiments, another vessel test can be pressure testing as may be required and or desired in a particular embodiment.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method of manufacturing a metal beverage vessel comprising:

stamping a metal sheet having an initial thickness to form vessel halves;

determining that the vessel halves do not have a polymer coating;

based on the determination, cleaning the vessel halves with commercial cleaner;

adhering the cleaned vessel halves together to form the vessel, the vessel adapted to contain a beverage and having an open end from which the beverage is to exit the vessel and a seam along vertical walls and bottom to contain the beverage within the vessel;

applying a decoration to an outside of the vessel;

applying a protective coating to an inside of the vessel;

curing the decoration on the outside of the vessel and the coating on the inside of the vessel simultaneously; and forming a top finish at the open end adapted to receive a closure to seal the beverage within the vessel.

2. The method in accordance with claim 1, further comprising selecting the top finish among one of a threaded outsert for receiving a screw cap closure, an insert for receiving threaded and snap closures, a flanged top for receiving a can top end, or a rolled top for receiving a crown type closure.

3. The method in accordance with claim 1, wherein the stamping a metal sheet comprises stamping the metal sheet into a first half having a first shape; and stamping the metal sheet into a second half having a second shape asymmetric from the first shape.

4. The method in accordance with claim 1, wherein the metal sheet is aluminum, aluminum alloy, steel, or a steel alloy.

5. The method in accordance with claim 1, wherein the adhering comprises adhering by way of ultrasonic welding, magnetic pulse welding, laser welding, adhesive bond, or mechanical fit between the vessel halves.

6. The method in accordance with claim 1, wherein applying the protective coating to the inside of the vessel comprises coating the inside of the vessel to form a barrier between a surface of the vessel and contents placed inside the vessel.

7. The method in accordance with claim 1, wherein the vessel is capable of containing the beverage at pressures less than 100 psi.

8. The method in accordance with claim 1, wherein applying the decoration to the outside of the vessel comprises decorating the vessel with a graphic, varnish, or shrink sleeve, wherein the graphic is applied by way of at least one roller or ink jet capable of applying a plurality of colors on a surface of the vessel.

9. The method in accordance with claim 1, wherein forming the top finish at the open end adapted to receive the closure to seal the beverage within the vessel comprises, selecting a closure adapted to allow a consumer to open and reseal the vessel.

10. The method in accordance with claim 1, wherein temporarily securing the vessel halves comprises one or more of:

ultrasonic welding;

magnetic pulse welding;

laser welding;

adhesive bond.

11. The method in accordance with claim 1, further comprising precoating the metal sheet with polyethylene terephthalate (PET).

12. A method of manufacturing a metal beverage vessel comprising:

stamping a metal sheet having an initial thickness to form vessel halves;

confirming that the vessel halves do not have a polymer coating;

based on the confirming, cleaning the vessel halves with commercial cleaner;

adhering the cleaned vessel halves together to form the vessel, the vessel adapted to contain a beverage and having an open end from which the beverage is to exit the vessel and a seam along vertical walls and bottom to contain the beverage within the vessel;

forming a top finish at the open end adapted to receive a closure to seal the beverage within the vessel;

decorating an outside of the vessel with a graphic or varnish;

applying a protective coating to an inside of the vessel;

curing the graphic or varnish and the protective coating simultaneously; and identifying defects in the vessel, wherein the vessel is capable of containing the beverage at pressures less than 100 psi.

13. The method in accordance with claim 12, wherein cleaning the vessel halves with commercial cleaner comprises:

precleaning the vessel halves;

rinsing the vessel halves using methods comprising:

a cold water rinse; and a deionized water rinse; and drying the vessel halves.

14. The method in accordance with claim 12, wherein cleaning the vessel halves with commercial cleaner includes rinsing the vessel halves, and drying the vessel halves.

15. The method in accordance with claim 12, further comprising securing the vessel halves against each other in preparation for adhering the vessel halves together.

16. A method of manufacturing a metal beverage vessel comprising:

stamping a metal sheet having an initial thickness to form vessel halves;

determining that the vessel halves have a polymer coating;

foregoing cleaning of the vessel halves based on the determination that the vessel halves have a polymer coating;

temporarily securing the vessel halves such that the temporarily secured vessel halves can be transferred to adhering equipment;

transferring the temporarily secured vessel halves to the adhering equipment;

adhering the vessel halves together at the adhering equipment to form a vessel adapted to contain a beverage and having an open end from which the beverage is to exit the vessel and a seam along vertical walls of the vessel and bottom to contain the beverage within the vessel; and forming a top finish at the open end adapted to receive a closure to resealably seal the beverage within the vessel, wherein the vessel is capable of containing the beverage at pressures less than 100 psi.

17. The method in accordance with claim 16, wherein the stamping a metal sheet comprises stamping the metal sheet into a first half having a first shape; and stamping the metal sheet into a second half having a second shape asymmetric from the first shape.

18. The method in accordance with claim 16, wherein the metal sheet is aluminum, aluminum alloy, steel, or steel alloy.

19. The method in accordance with claim 16, wherein the adhering comprises adhering by way of ultrasonic welding, magnetic pulse welding, laser welding, adhesive bond, or mechanical fit between the vessel halves.

* * * * *